US006214144B1

(12) United States Patent
Bassily et al.

(10) Patent No.: US 6,214,144 B1
(45) Date of Patent: Apr. 10, 2001

(54) METHOD OF MAKING TENSIONED MESH FOR LARGE DEPLOYABLE REFLECTORS

(75) Inventors: Samir F. Bassily, Los Angeles; Joseph Uribe, Long Beach, both of CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/360,850

(22) Filed: Jul. 24, 1999

Related U.S. Application Data

(62) Division of application No. 08/888,487, filed on Jul. 7, 1997, now Pat. No. 5,969,695.

(51) Int. Cl.[7] ..... H01Q 15/20; H01Q 15/14

(52) U.S. Cl. ..... 156/160; 156/91; 156/161; 156/229; 156/73.6; 135/33.2; 244/145; 343/912; 343/915

(58) Field of Search ..... 156/91, 160, 161, 156/229, 73.6; 343/915, 912; 135/33.2, 15.1; 244/145

(56) References Cited

U.S. PATENT DOCUMENTS 3,982,248 * 9/1976 Archer ..... 343/915 X
3,987,457 * 10/1976 Moore ..... 343/915 X
5,421,376 * 6/1995 Sinha ..... 343/915 X
5,488,383 * 1/1996 Friedman et al. ..... 343/912

* cited by examiner

*Primary Examiner*—Jeff H. Aftergut
(74) *Attorney, Agent, or Firm*—T. Gudmestad

(57) ABSTRACT

Apparatuses, methods and systems for mesh integration and tension control, mesh retention, and mesh management of mesh-type deployable reflectors. The mesh members are comprised of a plurality of wedge-shaped gore members, each of which are pre-tensioned initially utilizing double-sided tape in a temporary manner prior to final stitching. String-like chord catenary members are positioned in pockets formed on the outer end of the gore members. The mesh member is attached to a ribbed reflector frame structure through a plurality of nodal assembly mechanisms. The nodal assemblies have spring biasing members for tensioning radial and transverse chord members along the reflector surface. A plurality of string-like members positioned in washers on the mesh member are used to maintain a tension field in the mesh member when the reflector is in its collapsed and stowed condition. Pivotally mounted rack members are used to releasably hold the string-like members and thus the mesh member under tension when the reflector is in its collapsed and stowed condition. The rack members are automatically released as the reflector deployment commences, freeing the mesh for deployment.

10 Claims, 11 Drawing Sheets

METHOD OF MAKING TENSIONED MESH FOR LARGE DEPLOYABLE REFLECTORS

CROSS-REFERENCE TO RELATED APPLICATIONS

This is a division of application Ser. No. 08/888,487 filed Jul. 7, 1997 now U.S. Pat. No. 5,969,695.

The present invention is related to U.S. patent application Ser. No. 08/888,762, entitled "Edge-Supported Umbrella Reflector With Low Storage Profile" (PD-970097) and U.S. patent application Ser. No. 08/888,486, entitled "A Continually Adjustable Nonreturn Knot" (PD-960515), both of which are filed on the same day as the present invention and the disclosures of which are hereby incorporated by reference herein.

TECHNICAL FIELD

The present invention relates to systems for controlling and retaining tension in a mesh reflector in the deployed condition, as well as for managing the mesh during launch and transport in the stowed condition.

BACKGROUND ART

Dish-shaped mesh reflectors are used in various communication systems today, particularly on satellites in orbit around the Earth. Various systems are known for tensioning the various components of a mesh reflector as it is being made and assembled, and for managing the mesh during transport and launch. The known methods for tensioning the mesh reflectors, however, and for retaining the tension in the stowed and launch stages, are relatively costly and involve the use of unnecessary weight. For satellites in particular, any savings in cost and weight can be very significant.

Known mesh tensioning systems use rigid or semi-rigid edge strips along the outer edges (catenaries) of the mesh and often along the gore seams to lock-in tension in the mesh from the time the mesh is laid out until it is installed on a foldable reflector structure. Known systems for retention of the mesh typically use flat straps tensioned by metallic helical springs located behind the mesh.

Known mesh management systems are typically either containment or control systems. In the first category, the mesh is confined to a certain volume and limited in movement within that volume by friction as the layers of the mesh are compressed together. The second category uses positive means to control the location of the mesh prior to deployment and is more reliable.

Known methods, apparatuses, and systems for mesh integration and tension control, mesh retention, and mesh management, add additional weight and cost to the spacecraft and satellite. Although such systems are known to work relatively satisfactory, they may increase thermal distortion and make the adjustment of the mesh surface shape more difficult.

It is an object of the present invention to provide improved methods, apparatuses, and systems for mesh integration and tension control, mesh retention, and mesh management for mesh-type reflectors, particularly for use in satellites. It is also an object of the present invention to reduce the weight and expense of the tensioning, retention, and management systems for mesh reflectors.

It is another object of the present invention to avoid the use of semi-rigid and rigid strips on the mesh during manufacture and assembly, particularly to save weight and cost, enhance reflector transparency, and eliminate mesh stiffening. It is a still further object of the present invention to enhance thermal stability and mesh shape adjustability of a mesh reflector.

It is an additional object of the present invention to provide a more accurate and direct tensioning control system for a mesh reflector while at the same time reducing weight and solar blockage by eliminating straps and metallic springs used in prior art systems. It is also an additional object of the present invention to provide a mesh retention system which utilizes small bending springs located at chord intersections.

It is still a further object of the present invention to provide a mesh management system that provides complete mesh control that automatically releases during deployment of the reflector. It is another object of the present invention to use a mesh management system on a deployable umbrella-type reflector which controls the mesh and edge members in the stowed condition in order to assure reliable deployment of the reflector in space.

These and other objects and purposes of the present invention will become apparent from the following description of the invention, particularly when viewed in accordance with the accompanying drawings and appended claims.

SUMMARY OF THE INVENTION

The present invention provides unique methods, apparatuses, and systems for mesh integration and tension control, mesh retention, and mesh management of a mesh-type reflector. Any deployable mesh-type reflector can benefit from the present invention. In particular, current and future Geo-mobile communication satellites can use the invention in place of mesh reflectors utilizing known art and save expense and weight while enhancing performance and reliability. Other deployable reflectors may also be able to use certain features and aspects of the present invention.

When the mesh reflector is being made, gore-size tensioning tables are used to establish the requisite tension in the gores. Double-sided adhesive tape is used to temporarily lock-in the pre-tensions in the gores on the tensioning table until the gores are sewn together. String-like chord members positioned in sewn-over pockets at the outer edges of the gores serve as the catenary members. Once the gores are sewn together forming the flexible mesh reflector member, the pre-tensioned mesh member is positioned on a reflector framework made of a plurality of ribs arranged around a center hub in an elliptical or circular pattern. The mesh reflector is then secured to, and tensioned on, the reflector frame structure. The reflecting surface shape is approximated by many substantially flat trapezoidal facets whose corners or nodes are positioned near attachment points on the frame structure. The edges of the facets are retained in a substantially straight condition by a network of tensioned edge members positioned toward the focus side of the dish-shaped mesh reflector.

Small nodal assemblies with composite bending springs are positioned on each of the corners or nodes of the facets forming the mesh reflecting surface. The assemblies are attached to the framework structure through the mesh and include small "omega"-shaped springs. Adjacent pairs of the spring members are alternately oriented in the radial and tangential directions at the nodal assemblies to permit desired tensioning in both radial and tangential edge members. Light thermally stable chord members form the edge members constituting the retention network. Each chord member has one end attached to a bending spring and the other end attached to an adjacent nodal assembly, preferably using an unique adjustable knot mechanism.

Once all of the nodal assemblies and chord members are positioned in place, each chord member is tensioned to a specified value selected to minimize mesh pillowing and tangential loading on the reflector ribs. Compared to prior mesh assemblies which utilize straps tensioned by springs located behind the mesh, the chord member and nodal assembly system is lighter, less expensive, provides less solar blockage, and is easier to accurately tension.

The mesh management system in accordance with the present invention maintains the reflector mesh under tension control during ground handling, launch, and boom deployments, and then automatically releases the tension as the reflector is deployed into its final shape and position. The mesh management system utilizes a framework of chord members, small pieces of tubing, guide washers, beads, and a pair of comb-like rack members. The guide washers are attached to the non-focus side of the mesh reflector member and chord tensioning members are positioned through the washers from the central hub of the reflector to the outer edges of the gores. A single chord member is used near the hub of the reflector and is spliced into two pieces as it approaches the outer edges of the gores. The inner ends of the mesh management chord members are secured to the reflector hub while loops formed at the outer ends are individually slipped over teeth or fingers of the comb-like rack members. The rack members in turn are pivotally secured to the main reflector rib member. Small flexible tubular members are positioned over the mesh management chords adjacent the outer edges of the reflector and beads or similar structures are positioned on the tubular members and used to help hold the mesh into a certain configuration for stowing and launch.

With the mesh management system, the chord members force the majority of the gore material inwardly when the reflector is collapsed and stowed. Near the outer edges of the mesh, however, the management system with the chord members and beaded tubular members urge the outer portions of the mesh upwardly toward the hub or center of the reflector. When the reflector is stowed, loops at the ends of the mesh management chord members are secured to the rack members and the comb teeth are retained in a certain orientation prohibiting release of the chord members. When final deployment commences, the rack members are allowed to rotate allowing the loops to slide off freeing the chord members and tubular members.

With the present invention, initial constraint and final release of the comb-like rack members is achieved without the need for an active release system or separate ground commands. The present invention provides mesh control at less expense and weight and is more reliable than known systems. The present invention requires fewer elements and control steps in order to disengage the stowed mesh and free it at time of deployment.

The above and additional elements, features, benefits and advantages of the present invention will become apparent from the following description of the present invention, particularly when viewed in accordance with the attached claims and accompanying drawings.

BEST MODE FOR CARRYING OUT THE INVENTION

Figure 1:
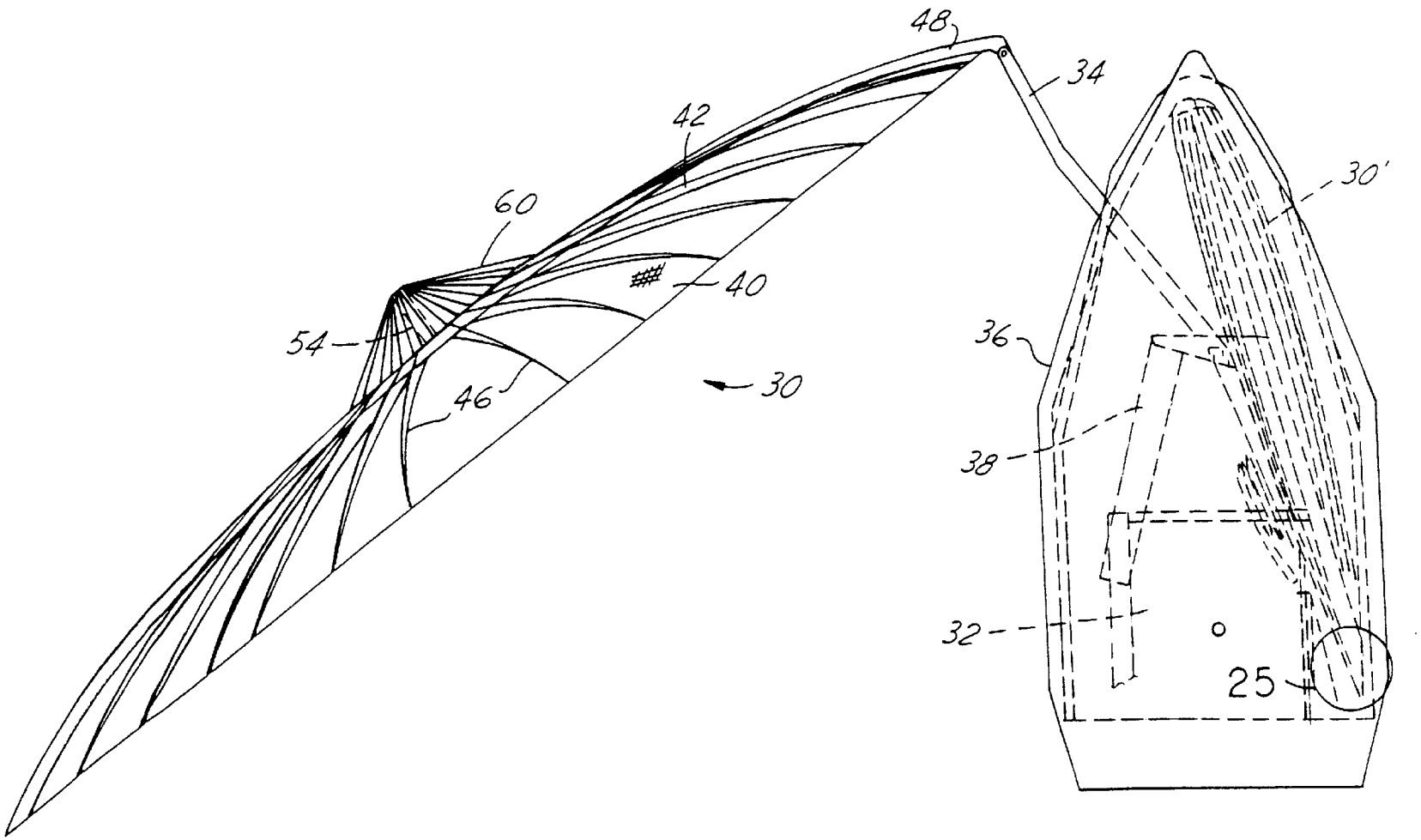
FIG. 1 illustrates a spacecraft and satellite communication system with a dish-shaped reflector member.

As indicated above, the present invention relates to unique methods, apparatuses, and systems for mesh integration and tension control, mesh retention, and mesh management of a mesh reflector system preferably for use with a spacecraft or satellite. A deployed dish-shaped communication reflector member utilized with the present invention is shown in FIGS. 1 and 3 and is indicated by the reference numeral 30.

The invention is a large deployable, offset-fed reflector 30 which uses a soft tricot mesh as its reflecting surface. The overall arrangement depicting both the deployed and stowed configurations is shown in FIG. 1. The back-up support structure uses an umbrella-like construction with an odd number of contoured radial ribs arranged around a small center circular hub. One of the ribs, referred to as the main rib member, has a heavier torque-box construction and is used to provide an "edge-support" for the reflector. The remaining "secondary" ribs are of a lighter, planar-truss construction and are tapered toward their outer edges. A deployment boom or arm is used to connect the reflector to the spacecraft or satellite.

The present invention is also related to the invention entitled "Edge-Supported Umbrella Reflector With Low Storage Profile" (PD-970097) which is the subject of co-pending related U.S. patent application Ser. No. 08/888,762, which is assigned to the same assignee as the present invention. The disclosure of this related patent application is incorporated herein by reference.

Figure 3:
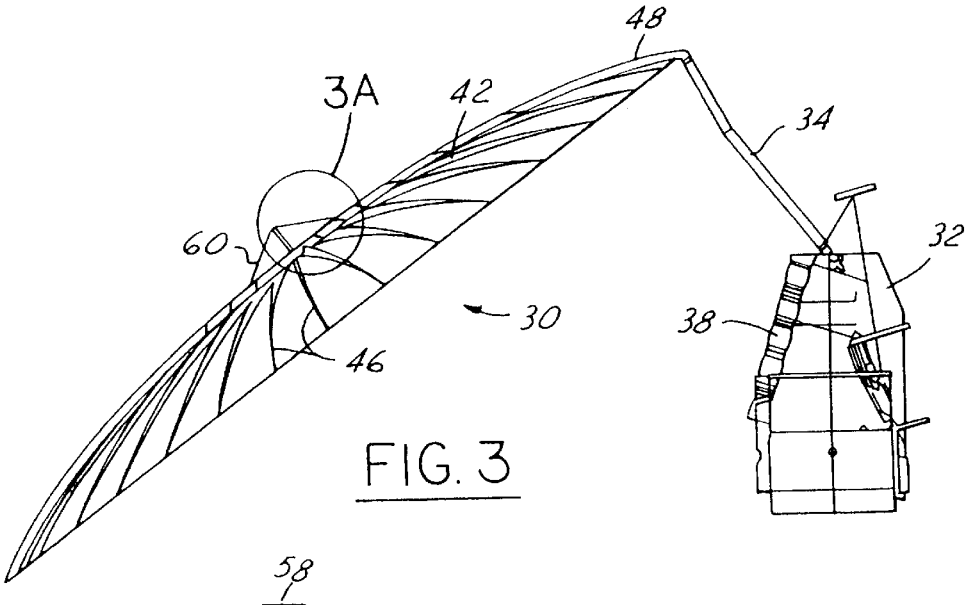
FIG. 3 illustrates a reflector member in its deployed condition.

When the reflector 30 is utilized in a satellite communication system, the reflector is deployed in the position shown in FIGS. 1 and 3 and connected to the spacecraft body member 32 by the deployable boom or arm member 34.

Figure 2:
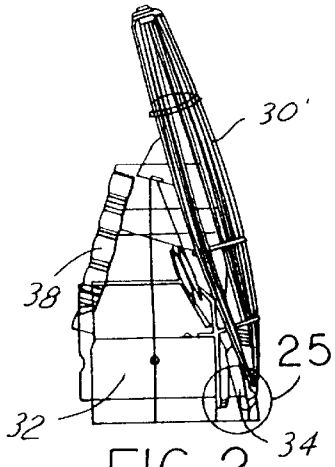
FIG. 2 illustrates a reflector member in its stowed and launch position on a spacecraft.

The reflector member is shown in its collapsed and stowed position in FIGS. 1 and 2 and referred to by reference numeral 30'. The reflector member is contained in its stowed position for launch and transport to its orbiting site in space. In this regard, the satellite body member 32 and reflector member 30' are positioned in the payload fairing of the rocket structure 36, as shown in FIG. 1. After the communication satellite is released from the payload fairing 36, the reflector member 30 is deployed from its stowed position 30' to its deployed position 30 by appropriate commands from the ground control.

The spacecraft 32 has an antenna feed 38 which is directed toward the reflector 30. Due to the positions and orientations of the reflector and antenna feed, the reflector member 30 has an elliptical shape. This is better shown in FIGS. 4 and 19. It is to be understood, however, that the present invention is not limited to reflectors having an elliptical shape or any certain size. Instead, the present invention can be used with many types of deployable reflectors, whether elliptical, circular or any other shape necessary for use with the satellite or other communication system.

For satellite use, the present invention has particular use in current and future Geo-mobile communication satellites. The invention saves significant expense and weight while enhancing performance and reliability of the reflector.

More specifically, the present invention comprises a mesh reflector member 40 attached to a structural framework 42 which has a concave or dish-shape as conventionally known in the field. The key aspects of the present invention relate to systems and procedures for manufacturing, pre-tensioning, and assembling the gore members forming the mesh reflector member 40, systems and procedures for securing the mesh reflector member 40 on the framework structure 42 and tensioning it thereon, and systems and procedures for managing and maintaining tension in the mesh member 40 when it is contained in its stowed and launch position.

Figure 6:
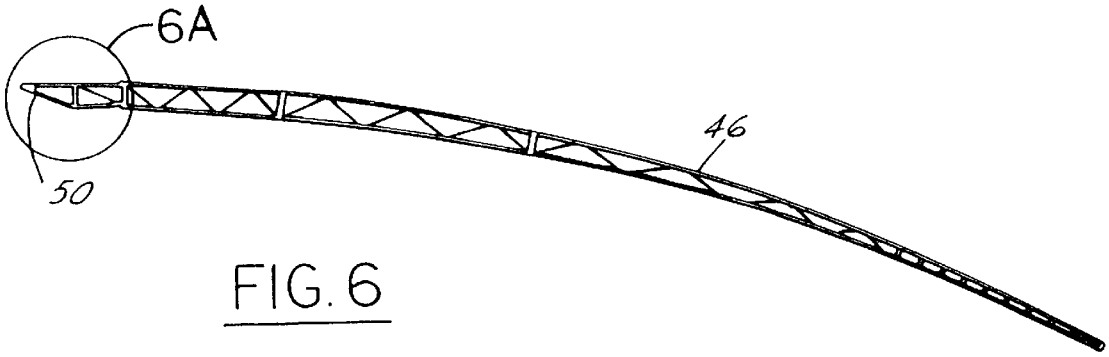
FIG. 6 is a representative view of one of the rib members of the frame structure for use with a mesh member in accordance with the present invention.
Figure 6A:
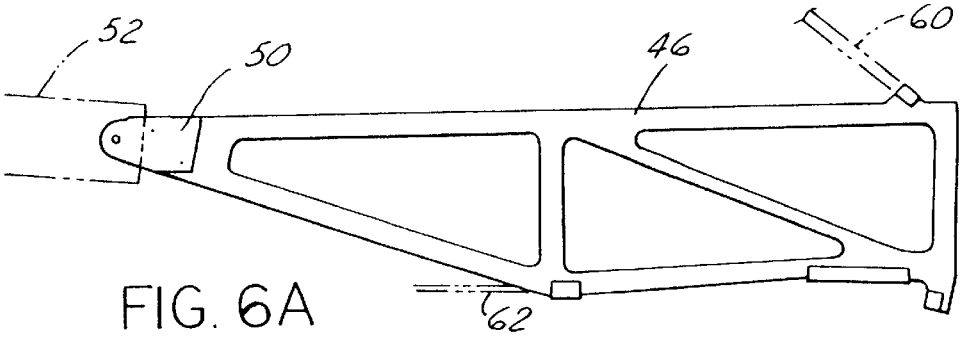
FIG. 6A is an enlarged view of a portion of the rib structure shown in FIG. 6.

The framework structure used with the present invention comprises a plurality of curved rib members 46, one of which is shown in FIG. 6. The rib members 46 are preferably honeycomb truss members made from a Nomex core sandwiched between thin graphite face sheets for strength and reduction in weight. It is also possible, in accordance with the present invention to provide rib members of any conventional type, such as round tubular members and the like. With a particular reflector design utilizing the present invention, preferably one main rib member and thirty secondary rib members 46 are utilized; The main rib member 48 is the rib member which is connected to the deployable arm 34 and is wider and significantly stiffer torsionally than the secondary rib members.

Figure 3A:
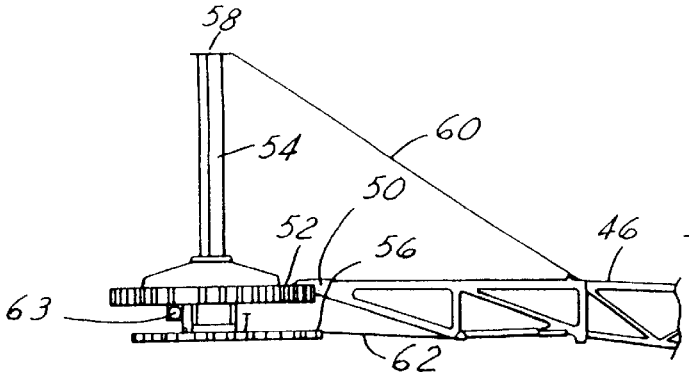
FIG. 3A is an enlarged view of a portion of the deployed reflector system as shown in FIG. 3.

The rib members 46 are approximately 1 inch in width and range from approximately 20 feet to 25 feet in length, depending on their position in the elliptical design or configuration of the reflector member. The rib members provide stiffness and stability for the mesh reflector and retain the reflector in its dish-shape or concave shape when the reflector is deployed. The inner ends 50 of the rib members 46 and 48 are pivotally connected to a substantially circular hub member 52. A central stem member 54 is attached to a base plate member 56 and is positioned as shown in FIG. 3A when the reflector member 30 is deployed. The outer end 58 of the stem member 54 is attached by a plurality of upper strap members 60 to the rib members 46 and 48, which help retain the rib members in their deployed positions. The base plate member 56 is also attached to the rib members 60 by a plurality of lower strap members 62. A motor 63 is used to slide the stem member 54 through the hub member 52 and into its deployed position which tensions the strap members 60 and 62.

Figure 4:
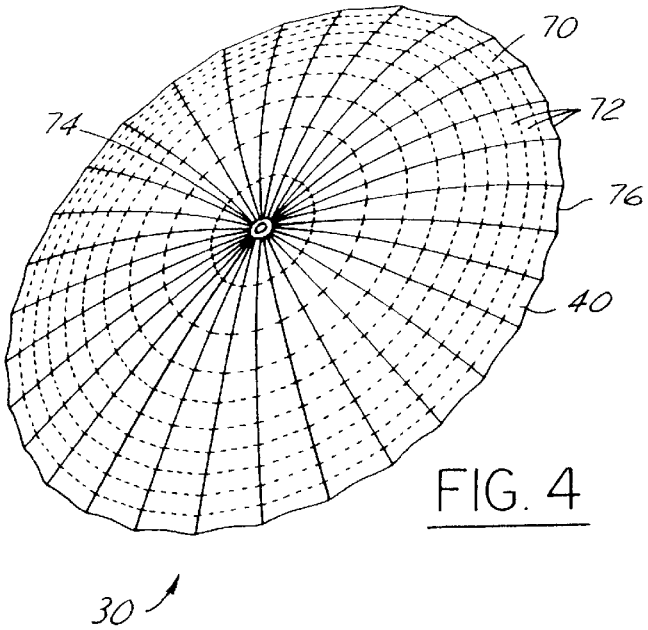
FIG. 4 illustrates a deployed reflector mesh in accordance with the present invention.

As shown in FIG. 4, the preferred reflector mesh member 40 is elliptical in shape and has thirty-one triangular or wedge-shaped gore members 70. Each of the gore members 70 has ten facet members 72 which are generally trapezoidal in shape, as better shown in FIG. 7. Each of the trapezoidal shaped facets have four corners or "nodes". Each of the gore members has an inner end 74 which is adapted to be attached to the central base plate member of the reflector and an outer end or edge 76 at its opposite end. The outer edges of the gores are radially tensioned by circumferential catenary members.

In the regard, although the present invention is preferably shown with thirty-one gore members and ten facet members, it is obvious that a greater or lesser number of gore members and facet members can be utilized depending on the precise size and shape of the reflector member to be utilized.

Figure 5:
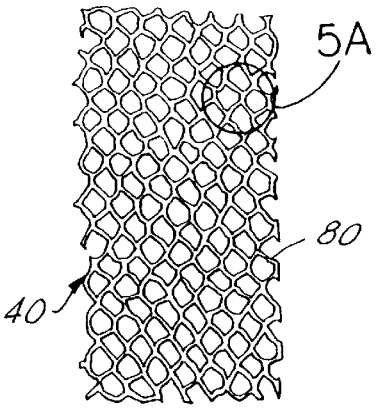
FIG. 5 illustrates a preferred mesh member for use with the present invention.
Figure 5A:
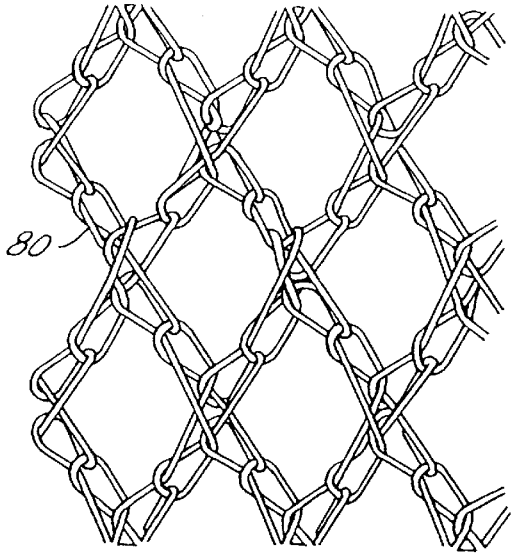
FIG. 5A is an enlarged view of a mesh structure preferred for use with the present invention.

The preferred structure or mesh used with the present invention is a two-bar tricot mesh structure with 5–10 openings per inch. A representative tricot structure of this type is shown in FIGS. 5 and 5A and referred to generally by the reference numeral 80. Also, preferably the material used for the mesh structure is a plated 55 denier Kevlar yarn, although any knitted or soft mesh structure conventionally used with mesh reflectors can be utilized.

The mesh structure 40 is initially installed under a certain minimum pre-tension at room temperature. This ensures adequate tension necessary for proper electrical performance at a worse case (maximum) temperature after extended thermal cycling (at end-of-life) of the material. The tension is typically different in the as-knit and transverse directions due to the orthotropic properties of the mesh. One of the methods used to maintain pre-tension in the mesh as it is made and installed, is to tension the catenary members around the outer perimeter of the mesh member 40. These members are enclosed in a pocket which can be referred to as the catenary tube.

Figure 15:
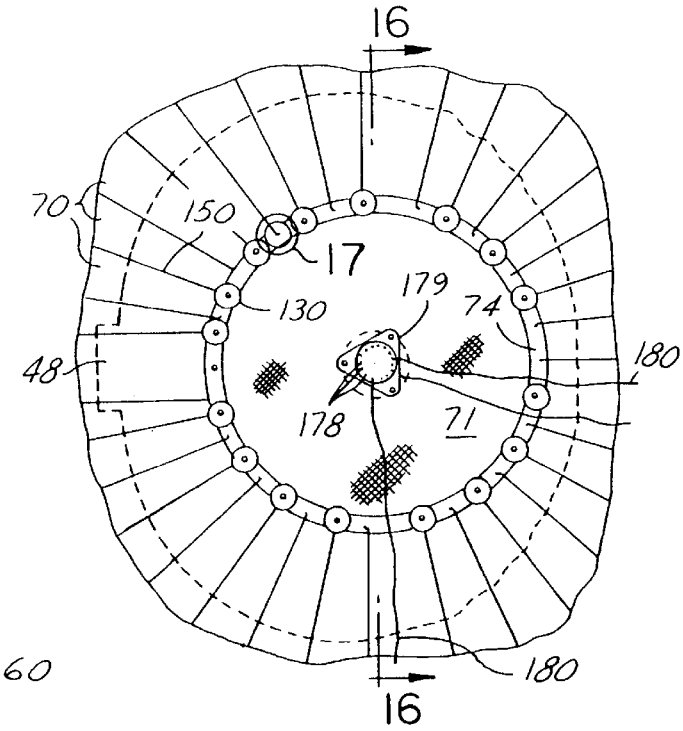
FIG. 15 is an enlarged view of the center or hub portion of a reflector member made in accordance with the present invention.
Figure 16:
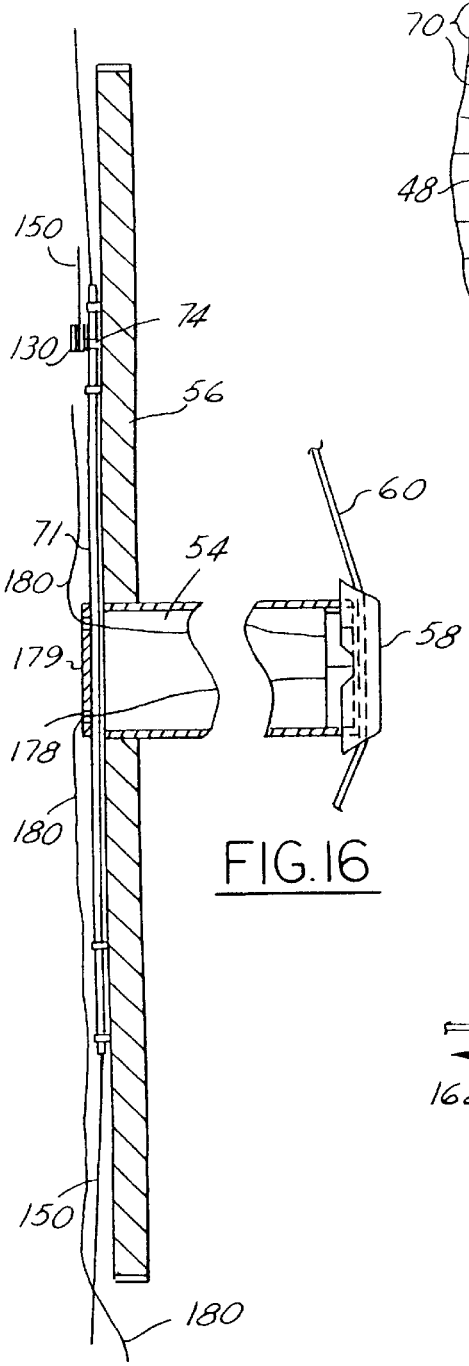
FIG. 16 is a partial cross-sectional view of the hub structure as shown in FIG. 15, the cross-section being taken along line 16—16 in FIG. 15 and in the direction of the arrows.

As mentioned above, the mesh member 40 of the reflector member 30 is divided into triangular shaped gore members 70 and the gore members are further subdivided by a set of ellipses into substantially flat trapezoidal facets 72. In order to avoid congestion due to the intersection of the large number of gores involved at the center of the mesh member, a circular center mesh panel member 71 is provided at that location, as shown in FIGS. 15 and 16. The center mesh panel member 71 is secured under tension around its edges to an annular flat ring member 74 which is approximately one foot in diameter and preferably made of Kevlar material. The ring member 74, in turn, is attached to the central base plate member 56.

Figure 8:
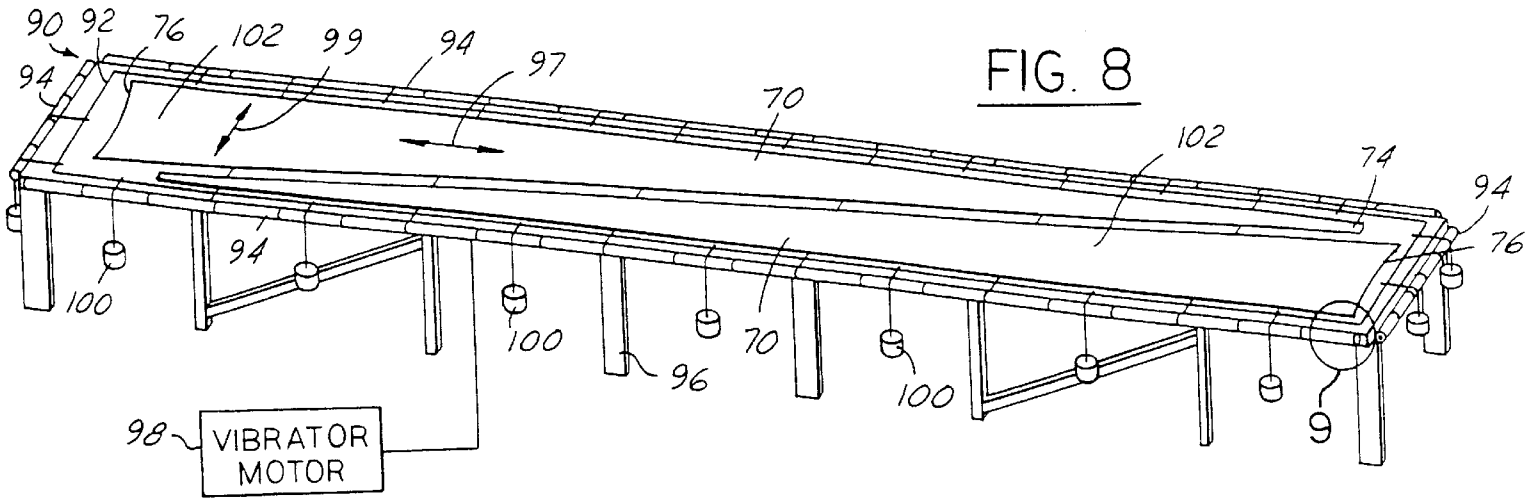
FIG. 8 illustrates a gore lay-up table for use with the present invention.

For pre-tensioning of the gore members 70, a mesh preparation lay-out table 90 is utilized. This is shown in FIG. 8. The table 90 has a large flat surface 92 which is sufficiently large to hold a pair of gore members 70 in the positions shown in FIG. 8. A plurality of roller members 94 are provided along the four outer edges of the table 90. The table surface 92 is isolated from the table support structure 96 using vibration isolators and at least one vibrator motor 98 is utilized to vibrate the surface 92 to reduce friction and ensure that the pre-tensioning of the mesh material is uniform through each of the facets and gore members. In this regard, in order to initially tension the mesh material on the table 90, a plurality of small weights 100, preferably spaced only a few inches apart, are secured to the edges of the mesh material and positioned over the roller members 94.

Figure 7:
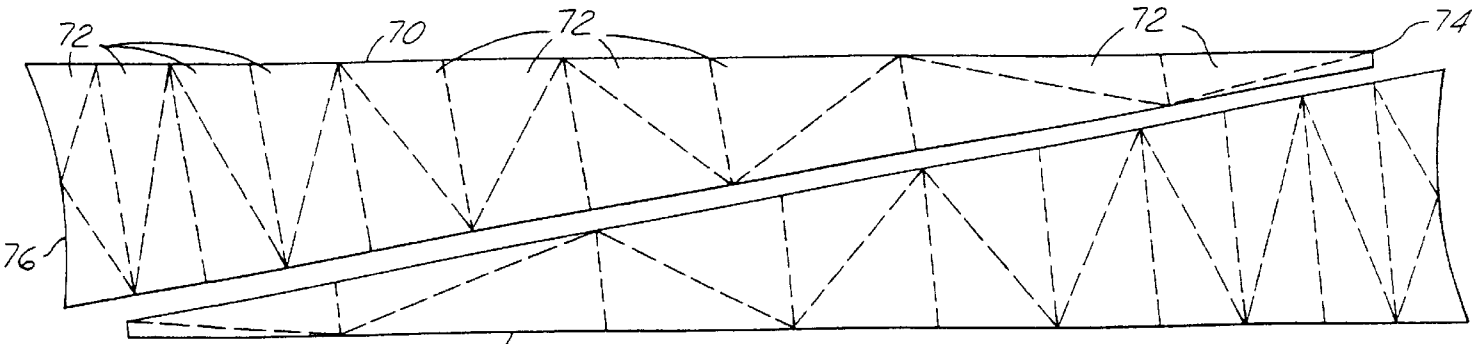
FIG. 7 illustrates a pair of gore members for use as part of a mesh reflector member in accordance with the present invention.

A set of Mylar plots representing flat pattern templates for each gore section is prepared using conventional computer graphic techniques. For efficient use of the material, each pair of gore patterns is set up in a head-to-toe manner as shown in FIGS. 7 and 8. The mesh preparation table 90 is sized to be able to handle the largest of the flat gore member patterns.

For preparation of the gore members, the mesh templates 102 are taped or otherwise secured to the surface 92 of the table 90. The mesh material is then laid over the templates and stretched using strings, hooks, and small dead weights 100 appropriately spaced around the four sides of the table. This produces the desired mesh tension in both the as-knit and mesh transverse directions. In this regard, the as-knit direction of the mesh on the table 90 is shown by the arrow 97 and the transverse direction is shown by the arrow 99.

Figure 9:
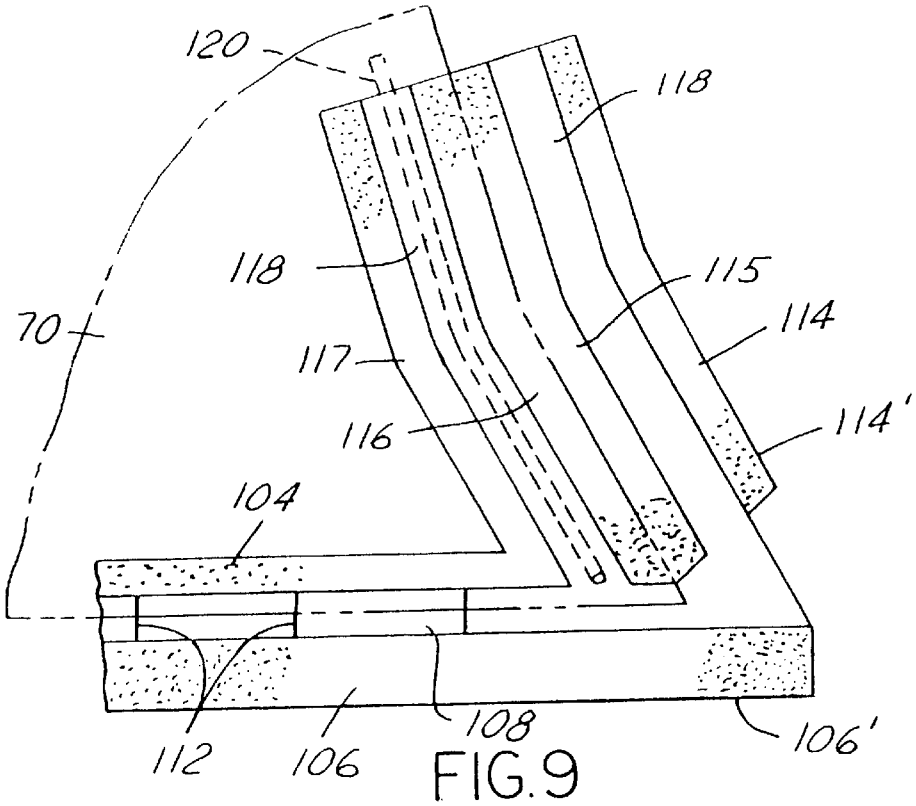
FIG. 9 is a portion of a gore member positioned on a lay-up table as shown in FIG. 8.
Figure 10:
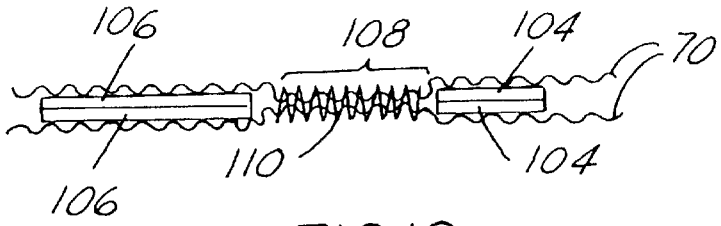
FIGS. 10 and 11 illustrate various steps in the formation of the pre-tensioned gore members in accordance with the present invention.

Tension within the mesh material on the table 90 is equalized by using the vibration feature as mentioned above. The tension strain in the mesh material is then "locked in" and the gore members are formed by placing two rows of a relatively stiff double-sided adhesive tape on the mesh forming the outline of the gores corresponding to the templates 102. As shown in FIGS. 9 and 10, two rows of tape 104 and 106 are placed along the elongated sides of each gore member, while four rows of tape 114, 115, 116 and 117 are positioned along the catenary edges 76. The two rows of tape 104 and 106 are positioned on either side of the desired gore seam lines with a sufficient gap or space 108 left between them to allow for subsequent sewing together of adjacent gore members with stitches 110.

Preferably, locations where the mesh member is to be attached to the reflector ribs, as well as other locations where the mesh member is to be attached to the mesh retention strings as discussed below, are marked on the mesh by appropriate indicators, such as stitches 112 using temporary colored threads. These indicators are accurately transferred from target locations computer plotted on the Mylar mesh templates.

The double-sided tape members are only provided for temporary use during the formation of the gore members. The tape holds the requisite shape and tension in the gore members until they can be stitched along the outside edges. Thereafter, the tape is pealed off and discarded. With the invention, no rigid or semi-rigid panels or members are permanently left in the gore members, and no added weight is included. As to the tensioning strain, preferably the mesh is tensioned on the order of 0.125 to 0.25 pounds/foot (about 2 to 4 ounces/foot).

Figure 11:
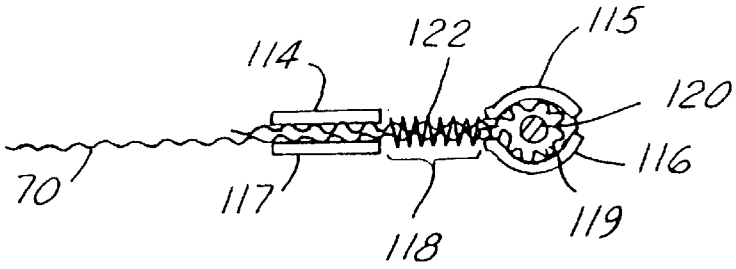

Preferably, tape member 104 is approximately 0.5 inches in width and tape member 106 is approximately 1.0 inch in width. Space or gap 108 is also approximately 0.5 inches in width. Along the outer or catenary edges of the gore members, the four pieces of tape member 114, 115, 116 and 117 are each approximately 0.5 inches in width. A 0.5 inch gap 118 is provided between the two catenary rows of double-sided tape members in order to provide a space for stitching in a pocket 119 for positioning of a string chord member 120 as shown in FIG. 11. The chord member 120 is preferably a length of Kevlar string approximately 0.50 mm in diameter and which is longer than the outer edges of the gore members in order to provide two loose ends for tensioning, as described below. When the outer ends of the gore members are folded over in the manner shown in FIG. 11 and stitched together by appropriate zig-zag threads 122, the tape members 114–117 are removed. The tape members are used to temporarily hold the requisite tension in the mesh member adjacent the ends of the gores and also to provide a temporary means for holding the ends in the folded over position, as shown in FIG. 11, thereby holding the chord member 120 therein until the final stitching 122 takes place.

Similarly, tape members 104 and 106 are utilized to temporarily hold the requisite tensioning in the gore members and to temporarily hold adjacent gore members together in an overlapping condition, as shown in FIG. 10, so they can be stitched in place by zigzag stitches 110. In this regard, after the two gore members are stitched together as shown in FIG. 10, the tape members 104 are removed and the overlapping free ends containing tape members 106 are trimmed from the mesh member.

Once the tape members 104, 106, and 114–117 are first positioned around the outer edges of each of the gore members 70 holding or "locking in" the requisite shape and tension, and the mesh and other attachment locations are marked up, the weights 100 are removed and the mesh material is trimmed on the table 90 into wedge-shaped configurations generally along the outer edges 106' and 114' of the tape members. Thereafter, once the adjacent gore members are stitched together as shown in FIG. 10, and the catenary ends of the gore members are overlapped entrapping Kevlar chord members 120, as shown in FIG. 11, the mesh material is further trimmed along the outside edges of the stitching 110 and 122 in order to finish the completed gore members 70.

The present invention avoids the use of rigid or semi-rigid strips (e.g. graphite strips) used with some known mesh-type satellite reflectors. This saves weight and cost, enhances reflector transparency, and eliminates added mesh stiffening, thus enhancing thermal stability and mesh shape adjustability.

When the reflector member 30 is in its stowed and collapsed condition, the rib members 46 and 48 are positioned generally parallel to each other. This is shown in FIG. 1. On the other hand, when the rib reflector member 40 is in its deployed condition, the rib members are flared out in an umbrella-shape, such as shown in FIGS. 1 and 3. The rib members form a framework structure for the reflector which has a concave dish-shape. When the mesh member 40 is positioned on the reflector member consisting of the framework structure of rib members, a retention system is used to retain the mesh member in its desired shape. The tensioning should be adjusted such that the reflector member retains its precise concave shape and is not over-tensioned or under-tensioned. The system also retains the mesh member on the ribbed framework structure. The preferred tensioning system utilized in the present invention is shown in one or more of FIGS. 12–18.

Figure 12:
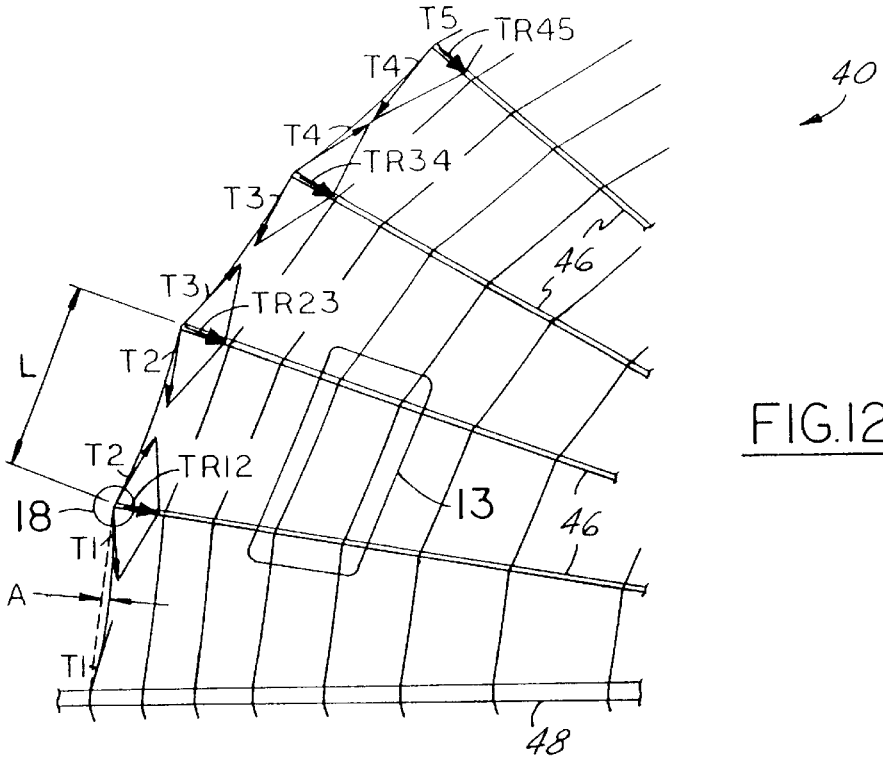
FIG. 12 depicts one of the several tensioning procedures utilized with the present invention.

FIG. 12 illustrates the forces and system for properly tensioning the chord members in the catenaries on the outer edges of the mesh member 40. As explained above, a Kevlar string-like chord member 120 is positioned in a pocket 119 (or catenary tube) in the outer edge of each of the gore members. The loose ends of adjacent chord members situated next to each other when the gore members are sewn together are tensioned adjacent the ends of the rib members 46. In FIG. 12, the length L is fixed once the geometry of the reflector member is established. The distance A is variable for each of the catenaries and is selected such that the appropriate tension is provided in the mesh member without bending the rib members in the circumferential direction. In this regard, the tension T can be approximately defined by the following formula:

$$T=p_r \cdot L^2/8A$$

where T is the catenary tension and Pr is the mesh radial tension. T1/T2 has a resultant force TR12 directed along the rib member 46. Similarly, the adjacent tensions and adjacent catenary members along each of the gore members have resultant forces in directions along their respective rib members. Once A is selected for the first catenary member, then A can be determined for each of the other gore members around the circumference of the mesh member.

The ideal mesh reflecting surface shape is approximated by the plurality of substantially flat trapezoidal facets contained on the mesh member. When the mesh member is positioned on the framework structure comprised of the rib members 46 and 48, the four corners or nodes of the facets are positioned along the rib members and are adapted to be the attachment points for the mesh member 40 on the framework structure. The four perimeter edges of each of the facets are kept substantially straight by a network of tensioned chord members positioned along the length of each of the rib members and in the front (or focus side) of the reflector. At the same time, and for the same reason, a plurality of chord members are positioned stretched between adjacent rib members along each of the edges of the facet members, again connecting the corners or nodal points.

Figure 13:
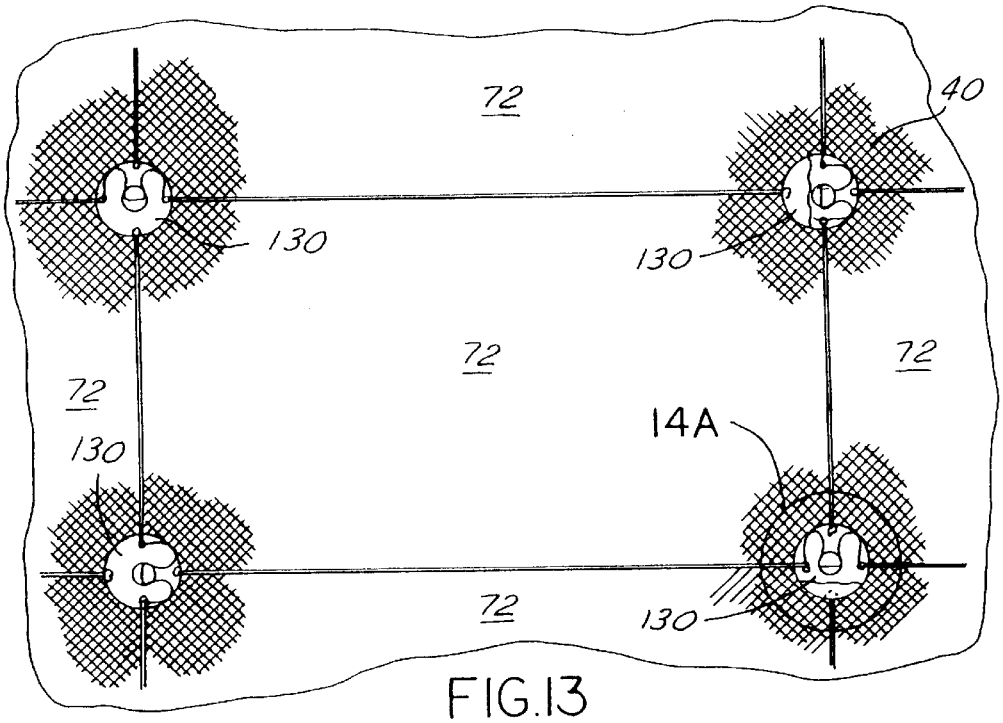
FIG. 13 is an enlarged view of a portion of the mesh reflector member shown in FIG. 12 and illustrating the unique nodal assemblies and chord members utilized with the present invention.
Figure 14A:
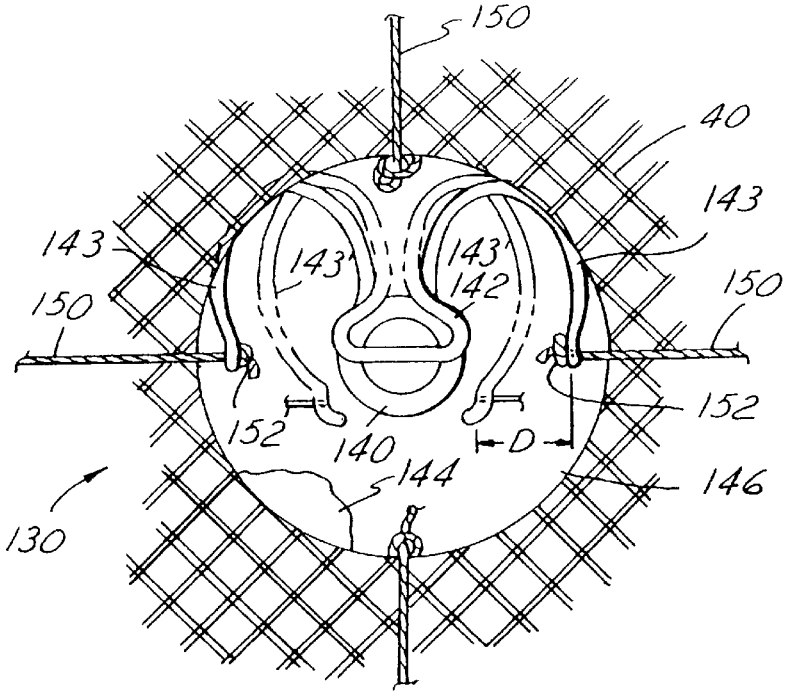
FIG. 14A is a plan view.
Figure 14B:
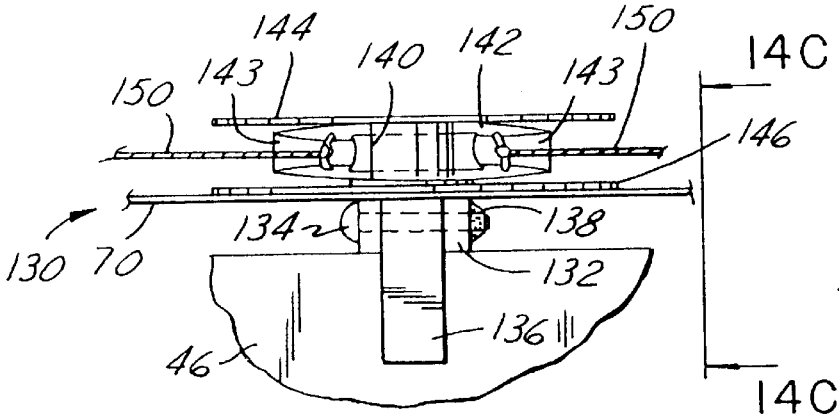
FIGS. 14B and 14C are elevational views of a nodal assembly preferably utilized with the present invention.
Figure 14C:
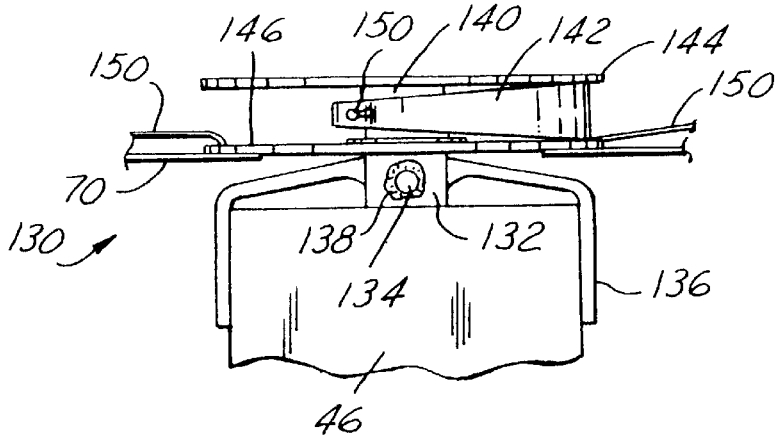

Unique nodal assembly mechanisms 130 are positioned at each of the corners of the trapezoidal facets along the rib members. The positioning of the nodal assemblies 130 is particularly shown in FIG. 13 and the details of the nodal assemblies 130 themselves are particularly shown in FIGS. 14A, 14B and 14C. In this regard, FIG. 14A is a top plan view of one of the nodal assembly mechanisms with its cover removed, while FIGS. 14B and 14C are side elevational views thereof.

The nodal assemblies 130 are small radio frequency (RF) transparent button-like devices and are positioned on the focus side of the mesh member 40. The nodal assembly mechanisms 130 have a pair of prongs or clevis members 132 which are pivotally attached by rivet or pivot member 134 to a U-shaped support bracket 136 positioned on the rib members 46. The prongs 132 are fed through mesh openings to the back (non-focus) side of the mesh. The assembly members 130 are pivotally attached to the rib members so that they can be self-aligning to the ideal reflecting surface. This permits the nodal spring assemblies to be tangential to the mesh surface while tilting to one side or the other relative to the rib, thus compensating for the angularity between the mesh member and the rib planes. The pivot members 134 are preferably small rivet members and are secured to the bracket members 135 and clevis members 132 by an adhesive 138 or the like. Also, as shown, the attachment bracket members 136 are adapted to fit over the rib members 46 and are secured thereto by bonding with an appropriate adhesive.

Nine or ten nodal assembly members 130 are positioned along each of the rib members. For every other rib, one nodal assembly member 130 is positioned on the ring member 74, as shown in FIG. 15, and the other nodal assembly members 130 on all ribs are positioned on the intersections of the facet members on the rib members. The outer ends of the rib member are connected to the mesh members in another manner, as described above and as further described below with reference to FIGS. 18A–18C. Also, for illustrative purposes, a series of ten nodal assembly members 130 positioned along one of the rib members is depicted in FIG. 19.

Each of the nodal assembly mechanisms 130 has a central stem or body member 140, an omega-shaped composite (fiberglass) bending spring member 142, a base plate member 146, and a cover member 144. The Omega-shaped spring members housed within the nodal assemblies provide a constant, repeatable and easily measurable tension to the chord members 150 which are positioned between adjacent assembly mechanisms 130. Each of the spring members 142 has a pair of spring arm members 143 that are secured to adjacent aligned chord members 150, such as by use of a knot structure sealed with a fast curing adhesive.

As shown in FIG. 14A, the arm members of the spring member 142 are shown in their untensioned positions in phantom lines 143*a* and in their biased and tensioned positions by the reference numerals 143. As shown in FIG. 13, the nodal assemblies and spring members 142 are alternately oriented in radial and tangential directions on the reflector member 30 at the various nodal positions. This permits proper tensioning of both the radial and tangential chord or edge members 150.

The Omega-shaped spring members are preferably made of a fiberglass reinforced composite (which may have a low concentration carbon powder to prevent electrostatic discharge), have a high RF transparency, a PIM-free nature, and high structural efficiency. Such material also has a high elastic bending strain limit, a high specific elastic bending strength, and a high specific elastic bending energy absorption. As a result, spring members made of such material can have a weight less than 0.2 grams, a free length of approximately 0.25 inches, and provide greater than 0.30 inches of elastic deflection, while elastically storing greater than 0.75 pound-inches of energy. The Omega-shapes of the spring members 142 also provides for a large bending radius at the location of highest bending moments and thus minimize tangential and through-the-thickness stresses. For higher energy absorption efficiency, the spring members 142 are tapered in width, as shown in FIGS. 14B and 14C. With such a structure, the spring members are widest at the maximum bending moment location and narrowest near their free ends where the bending moment is minimal. This increases the spring efficiency at minimal cost and without deterioration in manufacturing accuracy.

In order to enhance the efficiency of the spring members 142 and the nodal assembly mechanisms 130 around the surface of the reflector member 40, a plurality (preferably three) different spring members 142 are provided for each reflector member 30. Each of the spring members has a different maximum and minimum width and are used at different locations on the reflector member depending upon the chord tensioning requirements for those locations. The different spring members can be produced from the same basic molding/layup operation by simply varying the width of the spring members when they are cut from the mold.

The cover members 144 which attach to the stem or body member of each of the nodal assemblies 130 can be an injection molded member which "snaps" onto the body member 140, or a machined fiberglass disk bonded to the body member. The cover member 144 prevents possible entanglement of the mesh material which could result from contact between the mesh member and/or retention chords with the Omega-shaped springs during launch or weightlessness in space prior to deployment.

The radial and tangential chord members 150 are preferably made of 600–1200 denier Kevlar (or Vectran) material and form a "spider-web" retention network. One end of each of the chord members 150 is attached to an Omega-shaped spring member using a knot mechanism or the like which is later sealed using a fast curing adhesive 152. The other end of each of the chord members 150 is attached to the base plate member 146 of the nodal spring assembly mechanism 130. After the mesh and spider-web network are attached to the ribbed reflector structure, each of the chord members 150 is tensioned to a specific tension level.

The tensioning of the chord members 150 should satisfy two criteria. First, the tension should be sufficiently high to limit mesh pillowing (which is its tendency to move toward the focus of the reflector caused by the mesh tension and curvature). Since the various chord members have varying lengths, and since the tension required is proportional to the square of the chord length, the required minimum tension varies significantly from one chord member to another. Secondly, since the reflector rib members are relatively flexible in the circumferential direction, the tensions in any pair of circumferential chord members meeting at a particular rib member should be proportioned such that the resultant force lies in the plane of the rib member.

As indicated above, the lightweight Kevlar ring member 74 is located adjacent the outer edges of the mesh circular center panel member 71. The ring member 74 is bolted or otherwise secured to the reflector hub 56 at a number of positions with plastic fasteners such as screws. The ring member 74 also has a plurality of holes or openings (not shown) for accepting the attachment clevis members 132 of the nodal spring assembly mechanism 130. The clevis members are secured to the ring with small rivets which are fed through the clevis holes as they protrude behind the ring. The free ends of the rivets are swaged or upset to prevent them from being loosened or removed during handling and launch vibration.

Two rows or sets of nodal spring assemblies 130 are positioned along the main rib member 48. The base plate members 146 of the assembly mechanisms 130 are bolted or otherwise secured to the edges of the main reflector rib 48 at the appropriate facet nodal locations. The nodal spring assembly members 130 are also preferably pivotally attached to the main rib member 48 using rivets sealed with an adhesive.

As shown in FIG. 15, sixteen nodal assembly members 130 are positioned around the center ring member 74. These resiliently connect one-half of the radial chord members 150 to the center of the reflector. The other radial chord members 150 are fixedly secured, such as being tied and glued, to the center ring member 74. The alternate biased and unbiased connection of the radial chord members to the center ring member 74 is a continuation of the manner in which the chord members 150 are tensioned throughout the face of the reflector member.

Figure 17:
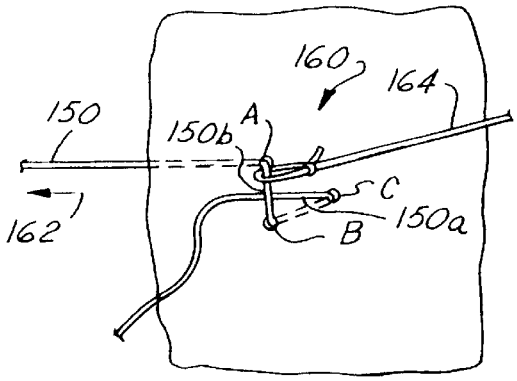
FIG. 17 illustrates a representative knot mechanism preferred for use with the present invention.

When the chord members 150 are attached to the base plate members 146 of the nodal spring assembly mechanisms 130, they are preferably secured with a knot mechanism 160 as shown in FIG. 17. Also, preferably a similar knot mechanism 160 is used to secure the radial inner ends of the chord members 150 to the center ring member 74. The latter situation is shown in FIG. 15 by the circular area numbered with the reference numeral 17, which is a reference to FIG. 17. In this regard, the knot mechanism utilized with the present invention is the subject of a separate patent application filed concurrently herewith, namely U.S. Ser. No. 08/888,486, entitled "A Continuously Adjustable Non-return Knot" (PD-960515), which is assigned to the same assignee as the present invention. The disclosure of that co-pending patent application is incorporated herein by reference.

In general, the preferred knot mechanism 160 used with the present invention utilizes a series of three holes, referenced by the letters A, B and C in FIG. 17, in which the end of the chord member 150 is threaded through in the manner shown. Since the end 150*a* of the chord member 150 is threaded under portion 150*b* of the chord member, the knot mechanism is self-tightening when force is applied in the direction of the arrow 162 to chord member 150. When it is desired to release the tension in the chord member, a release string member 164 is utilized. The release member 164 is attached to portion 150*b* of the chord member 150 and when pulled, allows the end 150*a* of the chord member to free itself and slide back from beneath portion 150*b* thus relieving the tension in the chord 150. One of the main advantages of the knot mechanism 160 is that the spider-web network comprising the plurality of chord members 150 can be loosely assembled in its preferred location and then be tightened or loosened and adjusted according to the requisite tension needed in the particular chord members.

In order to determine that the appropriate tension has been applied to a particular edge member, the deflection of the biasing elements (distance D in FIG. 14A) is measured using an appropriate measuring tool or instrument as the member is tensioned.

Figure 18A:
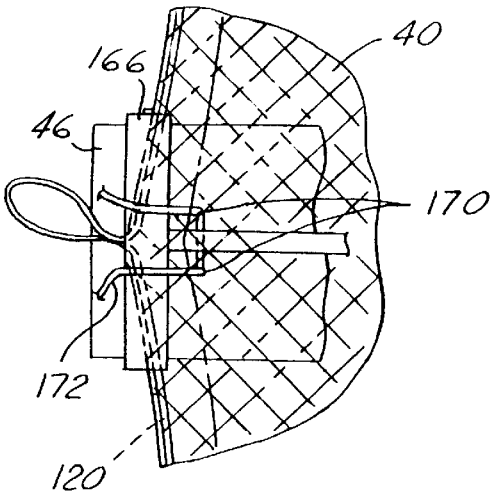
FIGS. 18A, 18B, and 18C are three elevational views illustrating the tensioning and securing procedure utilized at facet corners on the outer edges or catenaries of the mesh member.
Figure 18B:
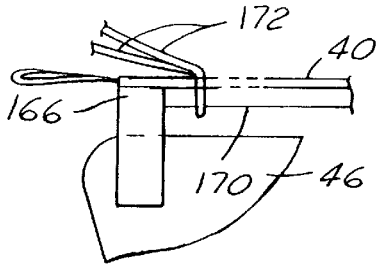
Figure 18C:
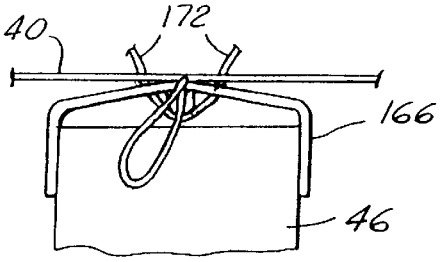
Figure 19:
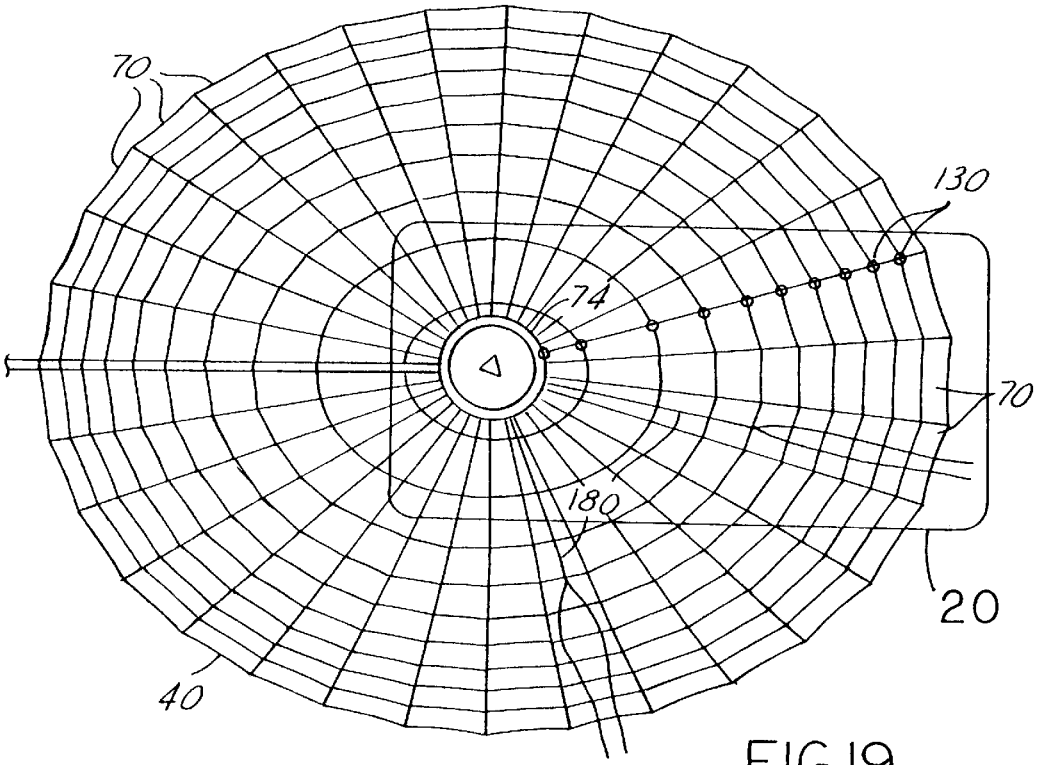
FIG. 19 is a plan view of a deployed mesh member in accordance with the present invention.

FIGS. 18A–18C show the manner in which the mesh member 40 is secured to the outer ends of the rib members 46. A saddle attachment bracket 166 is positioned over the rib member 46 and secured thereto by bonding with an appropriate adhesive. The string member 172 is passed through openings 170 in the mesh member 40 and its ends are wrapped around and tied to bracket member 166.

Compared to known reflector tensioning network systems which utilize straps and tensioning by springs located behind the mesh member, the chord members used with the present invention are lighter and less expensive, provide less solar blockage, and are easier to accurately tension.

The details and features of the mesh management system in accordance with the present invention are particularly shown with reference to FIGS. 19–25 (and also with reference to portions of FIGS. 15 and 16). For use on a deployable umbrella-type reflector member, the mesh management system controls the mesh and its edge members while in the stowed and launch condition. It is preferred to maintain the mesh under tension in the stowed position so that the mesh does not become repositioned or tangled during the tremendous vibration forces caused during transportation, handling, and launch to which the mesh member is subjected prior to deployment of the satellite and reflector. This ensures that the mesh member will not tangle, but will deploy when desired.

Once all of the nodal spring assembly mechanisms 130 and chord members 150 are loosely positioned in place around the surface of the mesh member 40, and the catenary chord members 120 are in position, final adjustments of the tension at all portions and positions on the mesh member can be made. For this purpose, the reflector rib structure and mesh member 40 are mated on the ground at an assembly site and the reflector member 30 is assembled and tensioned in its final configuration. Thereafter, the mesh retention system is affixed to the reflector member and mesh member so that the tension in the mesh member can be maintained when the reflector member is folded to its stowed and launch condition.

The mesh management system includes a set of flexible string-like chord members 180 which are attached at their inner ends to stem member 54, as shown in FIG. 16. The individual chord members 180 are positioned through holes or openings 178 situated in guide plate member 179 attached to one end of the stem member 54.

Figure 20:
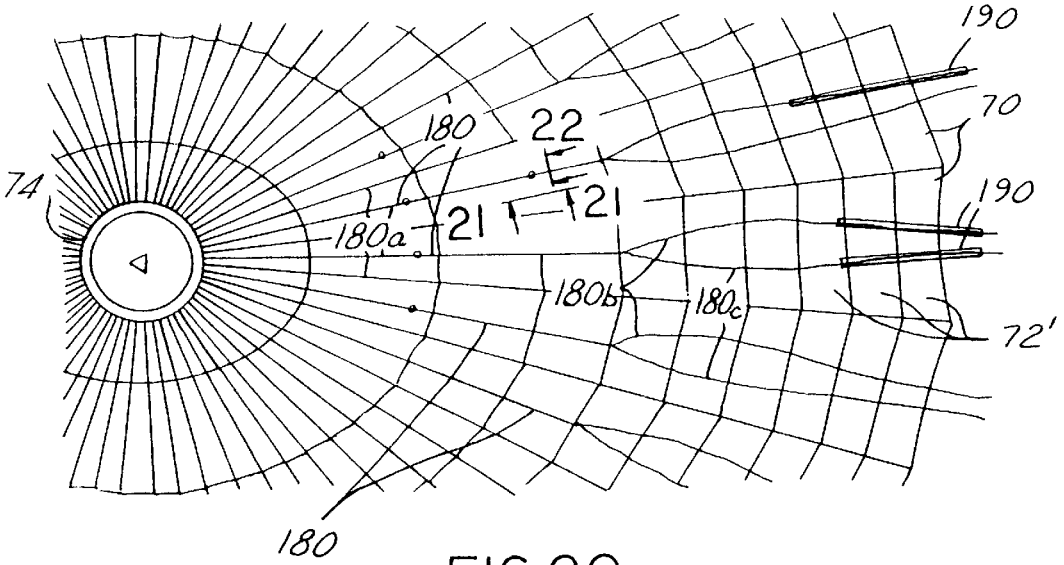
FIG. 20 is an enlarged view of a portion of the deployed mesh member as shown in FIG. 19.
Figure 21:
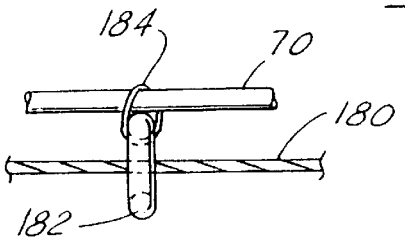
FIGS. 21 and 22 are partial cross-sectional views of a portion of the mesh and mesh management system as illustrated in FIG. 20, with FIGS. 21 and 22 being taken along lines 21—21 and 22—22, respectively, in FIG. 20.
Figure 22:
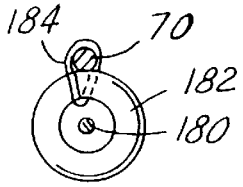

Although only a few representative chord members 180 are shown in FIGS. 19 and 20, it is to be understood that these are representative of the actual situation in which similar chord members 180 are positioned radially in each gore member around the entire circumference of the mesh member. The chord members 180 are positioned generally in between each of the rib members and thus approximately in the centers of each of the gore members 70.

Figure 23:
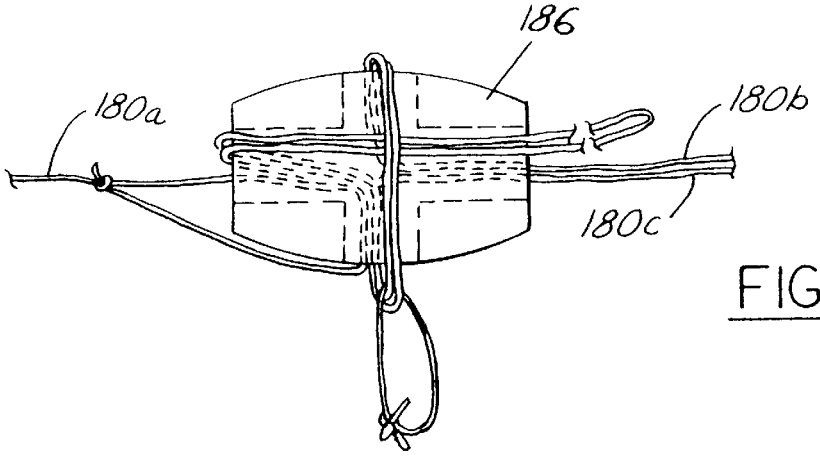
FIG. 23 illustrates a splicing mechanism for use with the present invention.
Figure 24:
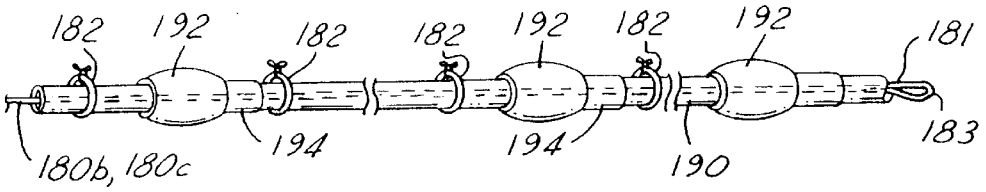
FIG. 24 illustrates a representative tubular member for use with the mesh management system.
Figure 25:
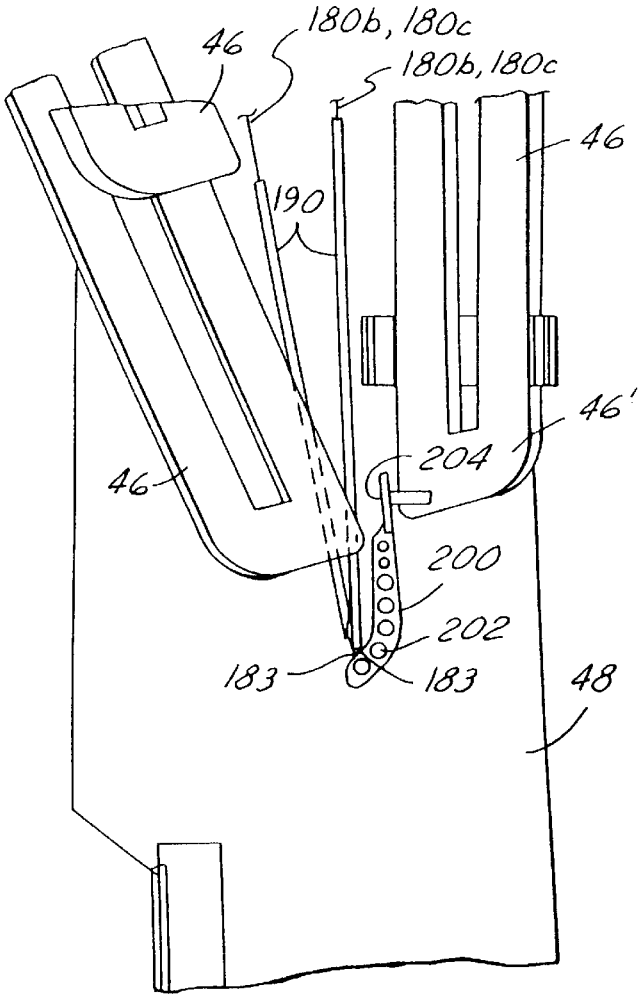
FIG. 25 is an enlarged view of a portion of the reflector member in a stowed condition (as shown in FIGS. 1 and 2)

Chord members 180 are positioned through small insulated guide washers 182 which are secured to the mesh member 40. The washer members 182 are positioned along the non-focus side of the mesh member gores along each of the facets approximately in the middle between the side edges of the gore members. The washers are tied by strings or thread members 184 to the mesh members 40 and hang from the mesh member in the manner shown in FIGS. 21 and 22. The inner portions of each of the chord members 180 comprises a single string or chord member 180*a*. This is shown in FIGS. 20 and 23. These members 180*a* are spliced by bead-shaped splice members 186 to form a pair of chord members 180*b* and 180*c* which extend toward the outer edges (catenary edges) of the mesh member. Preferably, a knot mechanism of the type shown in FIG. 17 and/or described in copending application Ser. No. 08/888,486 is utilized since it will permit the adjustment of the length, and tension, in the chords after the reflector is stowed. The two chord string members 180*b* and 180*c* are separated and pass through two sets of separate guide washer members 182 uniformly positioned near the center of the outer facet members 72, as shown in FIGS. 19 and 20.

Tubular members 190 are positioned over the outer ends of each of the string/chord members 180*b* and 180*c*. The tubular members 190 are positioned through washer members 182 attached to the underside of the three most outer facet members 72' as shown in FIG. 20. A plurality of bead members 192 are positioned and snugly fit on the tubular member 190 and secured from sliding in one direction by a piece of tape wrapped several times around the tubular member or by other stop member 194. The outermost end 181 of each of the string members has a loop member 183 thereon which is adapted to mate with one of the fingers or teeth 196 on comb-like rack members 200.

Figure 26:
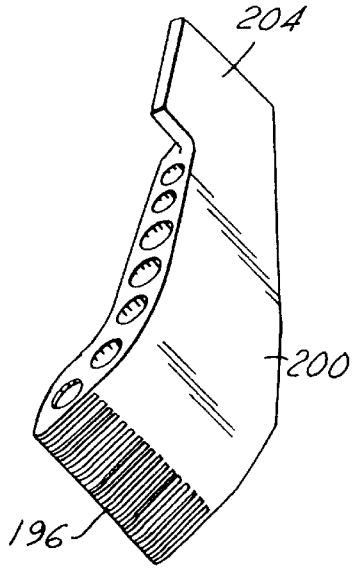
FIG. 26 illustrates one of the comb members preferably used with the present invention.

A pair of comb-like rack members 200 are provided, one on each side of the main reflector rib member 48. The rack members 200 are pivoted to the member 48 by pin member 202 which is positioned through one of the openings in the rack member 200. The rack member 200 has a plurality of teeth or fingers 196 on one end and each of the finger members are adapted to hold one or more of the loops 183 on the ends 181 of the chord/string members 180*b* and 180*c*. This is particularly shown in FIGS. 25 and 26. Preferably, in order to reduce potential tangling and to assure ready deployment, a separate loop 183 is positioned on each of the individual teeth or finger members 196.

Over the majority of the area of the mesh member, where the circumferential span of the mesh between the support structure members/rib members is less than twice the inside diameter of the stowed reflector bundle 30', the mesh and its retention chords are pushed radially inwardly by N number of management chord/string members and are stretched along the width of each gore. As indicated, the chord/string members are stretched between the stem member 54 at the center of the reflector and one of the teeth of the comb-like rack members near the outer perimeter of the reflector. Control of the gore and edge members is achieved by passing the stretched mesh management chord members through insulating washers which are sewn to the mesh member.

Near the bottom or outer perimeter edge of the mesh member where its circumferential span is several times the stowed bundle inside diameter, the mesh member and its edge catenary members are pushed upwards, that is toward the center or hub. Preferably, there are three points along each mesh management chord at which the washers 182 attached to the mesh are pushed upward or inwardly by the bead members 192 on the tubular members 190. The small flexible tubular members 190 are placed over the chord members near their outer edges and the beads are snugly fitted over the tube members and adapted to push the mesh upward by contact with the washer members 182. When the reflector is stowed, the tube members 190 are prevented from sliding off the chord members by the rack member 200.

When the reflector member 30 is stowed, or positioned in its stowed condition, the mesh management chord members 180 are secured to the comb-like rack members 200 through the loop members 183 at their outer or bottom ends. The teeth or fingers 196 are maintained in the direction pointing away from the center hub due to contact of the opposite end 204 of the rack members with one end 46' of one of the rib members 46. The rack member 200 is placed against the outer end of the rib member 46 closest to the member in which the rack member 200 is pivotally attached.

When final deployment commences relative to the reflector member 30, and the rib members 46 are spread out toward their umbrella-like configuration, the rack members 200 are allowed to rotate (around pivot member 202) until the teeth or finger members 196 are pointed in an upward direction thereby allowing the chord loops 183 to slide off. This frees the chord members 180 and tubular members 190 and allows the mesh member 40 to be deployed to its stretched and taught configuration as the reflector ribs move to their final deployed positions.

Along the inner ⅔ of the mesh, where the circumferential span is less than the inside diameter of the stowed reflector bundle, the mesh member is pushed radially inwardly by the chords 180*a* stretched along the middle of each gore member between points near the center of the hub and the bottom end of the reflector. Along the bottom or outer ⅙th of the mesh member, where its circumferential span is significantly larger than the stowed reflector bundle inside diameter, the mesh members are pushed upwards, that is toward the hub member, at several points (for example, 6 points per gore) until the mesh member and the circumferential chords are taught. Along the remaining intermediate ⅙ of the mesh member, the mesh circumferential spans are divided into thirds and several rings or washers are attached at about the one-third and two-third points. The rings are pulled radially inwardly, that is toward the center line of the stowed reflector, by two chord members 180*b* and 180*c* stretched near the middle of each gore.

The inside diameter of the tubular members 190 are sufficiently large to easily pass the chord members 180 and the outer loops 183 through them, and yet their outer diameters are sufficiently small to easily pass through the washer members 182. The bead members 192 are large enough to push the washers without passing through them, or jamming into them, and have center holes which snugly fit over the flexible tubing. The beads are positioned over the tubular members 190 at locations where the washers need to be pushed toward the hub member.

When the reflector is stowed with the lower (outer) chord loops 183 placed over the rack teeth 196 and the chord sufficiently tensioned, the flexible tubes 190 are pushed downward until they come in contact against the rack member 200. The bead members 192 are then slid along the tubes and used to push the washers 182 upwardly, that is toward the hub, until the mesh member is stretched and the circumferential mesh retention chord members are snug. The beads are then fixed such as they are prevented from sliding back along the tubes. This is accomplished by adding the piece of Kapton tape or stop members 194 which prevent the bead members 192 from going over them. When the racks are released and the mesh management chord members and loops 183 are freed, the tube members 190 are then permitted to slide downwardly away from the hub allowing the mesh to stretch as the reflector rib members 46 and 48 are opened outwardly.

When the deflector member 30 is deployed, the tube members 190 are positioned behind the reflector and behind the mesh member and are trapped by the bead members 192 and washer members 182.

With the present invention, initial constraint and the final release of the rack members is achieved without the need for any active release mechanism or system. Instead, this function is performed by using the relative positions and motion between pairs of reflector ribs, when the reflector is stowed and as deployment commences.

With the present invention, control of the mesh member is secured at significantly less cost and weight than known systems. The invention also is more reliable since is requires fewer elements to disengage in order to free the mesh member at deployment time.

While the best mode for carrying out the invention has been described in detail, those familiar with the art to which this invention relates will recognize various alternative designs and embodiments for practicing the invention as defined by the following claims.

What is claimed is:

1. A method for making a mesh member for a ribbed reflector structure, the mesh member comprising a plurality of gore members, the method comprising the steps of:

forming a plurality of individual wedge-shaped gore members;

tensioning each of said gore members;

after the step of tensioning, joining the gore members together to form the completed mesh member prior to installation on the ribbed reflector structure.

2. The method of claim 1 wherein the step of tensioning each of the gore members comprises:

placing a piece of mesh material on a table member;

applying weighted members around the circumference of said mesh material to form a desired pretension force in said mesh material; and applying tape members on said mesh material in the shape of said gore members in order to temporarily hold-in said pre-tension force in each gore member.

3. The method of claim 2 wherein said tape members comprises double-sided tape members.

4. The method of claim 2 further comprising the step of vibrating said table member in order to reduce friction forces in said mesh member and facilitate uniform tensioning throughout said mesh material.

5. The method of claim 2 wherein said tape members are removed after said gore members are joined together.

6. The method of claim 1 wherein said step of joining said gore members together comprises sewing adjacent gore members together.

7. The method of claim 1 further comprising the step of enclosing chord members in at least one of the edges of said gore members.

8. The method of claim 1 further comprising the step of marking a plurality of attachment points for use in accurately joining said gore members to said reflector structure.

9. The method of claim 8 wherein colored string members are used to mark said plurality of attachment points.

10. The method of claim 1 further comprising the step of joining the gore members together in the center of said mesh member with a round mesh panel member.

* * * * *